US005177410A

United States Patent [19]

Hashiguchi et al.

[11] Patent Number: 5,177,410

[45] Date of Patent: Jan. 5, 1993

[54] IMAGE DISPLAY DEVICE

[75] Inventors: Jumpei Hashiguchi, Neyagawa; Kiyoshi Hamada, Sakai; Kinzo Nonomura, Ikoma; Ryuichi Murai, Katano; Satoshi Kitao, Kyoto, all of Japan

[73] Assignee: Matsushita Electric Industrial Co., Ltd., Osaka, Japan

[21] Appl. No.: 708,869

[22] Filed: May 31, 1991

[30] Foreign Application Priority Data

May 31, 1990 [JP] Japan ..... 2-143099
Feb. 20, 1991 [JP] Japan ..... 3-26111

[51] Int. Cl.[5] ..... G09G 1/04; H01J 29/70; H01J 29/74

[52] U.S. Cl. ..... 315/366; 313/422; 313/437; 313/438

[58] Field of Search ..... 315/364, 370, 366; 313/422, 432, 434, 436, 437, 451, 456, 438

[56] References Cited

U.S. PATENT DOCUMENTS

| | | | |
|---|---|---|---|
| 3,911,317 | 10/1975 | Candy et al. . | |
| 4,158,210 | 6/1979 | Watanabe et al. | 315/366 |
| 4,232,253 | 11/1980 | Mortelmans | 315/370 |
| 4,542,322 | 9/1985 | Irie et al. | 315/366 |
| 4,955,681 | 9/1990 | Sekihara et al. | 313/422 |

FOREIGN PATENT DOCUMENTS

| | | |
|---|---|---|
| 0316871A2 | 5/1989 | European Pat. Off. . |
| 60-50849 | 3/1985 | Japan . |
| 61-149464 | 6/1986 | Japan . |
| 2-213034 | 8/1990 | Japan . |
| 346586 | 7/1960 | Switzerland . |
| 1029221 | 7/1983 | U.S.S.R. . |

*Primary Examiner*—Gregory C. Issing
*Attorney, Agent, or Firm*—Wenderoth, Lind & Ponack

[57] ABSTRACT

An image display device includes comb-shaped horizontal deflection electrodes disposed interleavingly in a first plane with a space therebetween for forming electron beam passages and comb-shaped vertical deflection electrodes disposed interleavingly in a second plane adjacent and parallel to the first plane. The capacitance between the horizontal deflection electrode confronting the vertical deflection electrodes and the capacitance between the horizontal deflection electrode confronting the vertical deflection electrode are made equal to each other. Also, the capacitance of the vertical deflection electrode confronting the horizontal deflection electrodes and the capacitance of the vertical deflection electrode confronting the horizontal deflection electrodes are made equal to each other, whereby the voltage effect induced by the other deflection electrode can be canceled and a good quality image can be obtained.

8 Claims, 10 Drawing Sheets

IMAGE DISPLAY DEVICE

BACKGROUND OF THE INVENTION

1. Field of the Invention

The present invention relates to the structure and drive technique of the cathode ray tube used as an image display device for television sets and computer displays.

2. Description of the Prior Art

According to a conventional image display device, there is proposed by the present inventor a flat plate type cathode ray tube described in Japanese Laid-open Patent Publication No. Hei 1-130453. FIG. 7 shows the internal electrode arrangement of the flat plate type cathode ray tube.

The cathode ray tube shown in FIG. 7 is composed of line-shaped cathodes 1-1, . . . . 1-4 as electron beam emission sources, a rear electrode 2 disposed on the opposite side to the image display screen 9 so as to face the cathodes 1, an electron beam take-out electrode 3, an electron beam modulation electrode 4, a vertical focus electrode 5, a horizontal focus electrode 6, horizontal deflecting electrodes 7, and 7*a*, and vertical deflecting electrodes 8 and 8*a*, and a display screen 9 with a fluorescent material applied thereon. These components are enclosed in a flat vacuum glass container (although not shown, a face plate 11 and a rear plate 12 constitute parts thereof).

Each line cathode 1 extends in the horizontal direction, and L pieces (L=4 in FIG. 7) of such line cathodes 1 are arranged vertically at a proper spacing. An electron beam taken out from the line cathode 1 is in a sheet-spread form, and is divided into M sections of fine electron beams by passing through holes of the electron take-out electrode 3. Then the fine electron beams are applied to the electron modulation electrode 4. The electron beam modulation electrode 4 is divided into M segments each extending in the horizontal direction so as to control the amount of electron beams to pass through the vertical segment independently and simultaneously (in FIG. 7, only 9 segments are shown).

The vertical focus electrode 5 and the horizontal focus electrode 6 respectively focus the beams in the vertical direction and horizontal direction.

The horizontally deflecting electrodes 7, 7*a* are provided to hold horizontally divided electron beams between two electrodes 7 and 7*a*, and deflect the beams horizontally by a potential difference given between the pair of electrodes 7 and 7*a*.

Similarly, the vertically deflecting electrodes 8, and 8*a* are provided to hold all the electron beams of one scanning line between a pair of electrodes 8 and 8*a* deflect the beams vertically by a potential difference given between the pair of electrodes.

Respective electron beams subjected to focus, modulation and deflections are accelerated by a high voltage applied on the screen 9 so as to effect bombardment of electron beams on the fluorescent film on the screen 9 for the generation of fluorescence. A fluorescent stripe is arranged so that as an example, one triplet set of R G B corresponds to each through hole in the electron beam modulation electrode 4.

Next, the method of giving deflection voltage in the conventional example will be described by showing waveforms in FIG. 8, taking the case of 480 scanning lines for the NTSC system as an example. The horizontal deflection is effected by step-shaped deflection signals h, and $h_1$ shown in FIG. 8. Since one deflection width during one H period is equal to a scan distance over one triplet set of R G B, the deflection signals h and $h_1$, which are synchronized with the horizonal synchronization signal H.D. are prepared in stepped waveforms that rise or fall at a rate of H/3 period. Accordingly, the electron beam stands still on respective fluorescent elements for each H/3 period.

On the other hand, the vertical deflection is effected by step-shaped deflection signals v and $v_1$. The time period in which electron beam is taken out from each cathode is (240/L)H, as indicated in cathode drive pulses K1 to KL, and each beam is deflected vertically in (240/L) steps (in FIG. 8, L=80, so that the number of vertical deflection step is 240/80=3). In the entire screen, during one vertical scanning period (one field), 240 lines of rasters are made by vertical deflections of 240 steps. In the next field, the interlace scanning is effected by shifting the voltage value so that the electron beams lands between rasters made in the previous field.

The horizontal deflection and vertical deflection are effected as described above, and the modulation is effected by changing the modulation signal w to R, G, and B in accordance with the deflection so as to form an image display section 10 with three vertical and three horizontal light emitting spots excited by one electron beam. A display image of one screen is obtained by aligning the image display sections regularly on the screen.

However, in the above flat plate type cathode ray tube, the horizontal deflection electrodes 7 and 7*a*, and the vertical deflection electrodes 8 and 8*a* are adjacently confronting each other and are electrically coupled to each other by comparatively large capacitances generated therebetween (in a 6" size screen, about 1000 pF), which adversely affects the deflection signals. Furthermore, even in the case where the horizontal deflection electrodes and the vertical deflection electrodes are not adjacently disposed, a similar phenomenon may take place between the horizontal deflection electrodes and the other adjacent electrodes or between the vertical deflection electrodes and the other adjacent electrodes.

Taking the horizontal deflection electrodes and vertical deflection electrodes as an example, when the output impedance of the deflection circuit driving the horizontal deflection electrodes 7 and 7*a*, and that of the deflection circuit driving the vertical deflection electrodes 8 and 8*a* are represented by RH and RV, respectively, and the capacitances between the horizontal deflection electrode 7 and the vertical deflection electrodes 8 and 8*a* are represented by $C_{7-8}$ and $C_{7-8a}$, respectively, and those between the horizontal deflection electrode 7*a* and the vertical deflection electrodes 8 and 8*a* are represented by $C_{7a-8}$ and $C_{7a-8a}$, respectively, the equivalent circuit for these deflection electrodes is represented as shown in FIG. 9. Since $C_{7-8}$ is not equal to $C_{7a-8}$ and $C_{7-8a}$ is not equal to $C_{7a-8a}$, the higher harmonics $v_h$ and $v_{h1}$ of the horizontal deflection signals h and h1 (FIG. 10*a*) induced in the vertical deflection electrodes 8 and 8*a* become signals having opposite polarities and different wave heights (FIG. 10*b*), and the combined waveform $v_h+v_{h1}$ (FIG. 10*c*) is superimposed on the original vertical deflection waveform so as to cause the change in the beam landing or focusing state, resulting in the image distortion, such as the unevenness in color or brightness.

SUMMARY OF THE INVENTION

In view of such problems, an essential object of the present invention is to provide an image display device capable of producing a high quality image free from the image distortion, the unevenness in color and brightness.

In order to accomplish the above-described object, according to the present invention, there is provided an image display device which is arranged to approximately equalize the capacitance between an electrode constituting an electron beam deflection means and the other electrodes adjacent thereto with that between the other electrodes of the electron beam deflection means and the other electrodes adjacent thereto.

More particularly, the distance and confronting area between one electrode constituting an electron beam deflection means and the other electrode adjacent thereto are made approximately equal to the distance and confronting area between the other electrode of that particular electron deflection means and the other electrodes adjacent thereto.

Further more particularly, insulation spacers are provided between an electron beam deflection means and other adjacent electrodes. Also, the ratio of the capacitance of the insulation spacer disposed between one deflection electrode of the electron beam deflection means and the other electrodes adjacent thereto to that of the capacitance of the insulation spacer disposed between the other deflection electrode of that particular electron deflection means and the other adjacent electrodes is selected so that the total capacitance formed between one deflection electrode and the other adjacent electrodes becomes nearly equal to the total capacitance formed between the other deflection electrode and the other adjacent electrodes.

Further more particularly, a capacitor is connected at least either between one deflection electrode constituting an electron deflection means and another adjacent electrode or between the other deflection electrode of that particular electron deflection means and the other adjacent electrodes.

As is clear from the foregoing description, according to the present invention, no difference is made between the capacitance formed between one deflection electrode constituting an electron beam deflection means and the other electrodes adjacent thereto and the capacitance formed between the other deflection electrode of the electron deflection means and the other electrodes adjacent thereto, whereby the waveform induced on other electrodes by the voltage applied on one deflection electrode and the waveform induced on other electrodes by the deflection waveform applied on the other deflection electrode cancel each other, so that the deflection waveform applied on one deflection electrodes makes no change in the voltage of the other electrodes.

Furthermore, the same can be said with respect to the waveform induced on one deflection electrode and that induced on the other deflection electrode by the voltage applied onto other electrodes.

BRIEF DESCRIPTION OF THE DRAWINGS

These and other objects and features of the present invention will become apparent from the following description taken in conjunction with the preferred embodiments thereof with reference to the accompanying drawings, in which.

DETAILED DESCRIPTION OF THE INVENTION

First Embodiment

Figure 1:
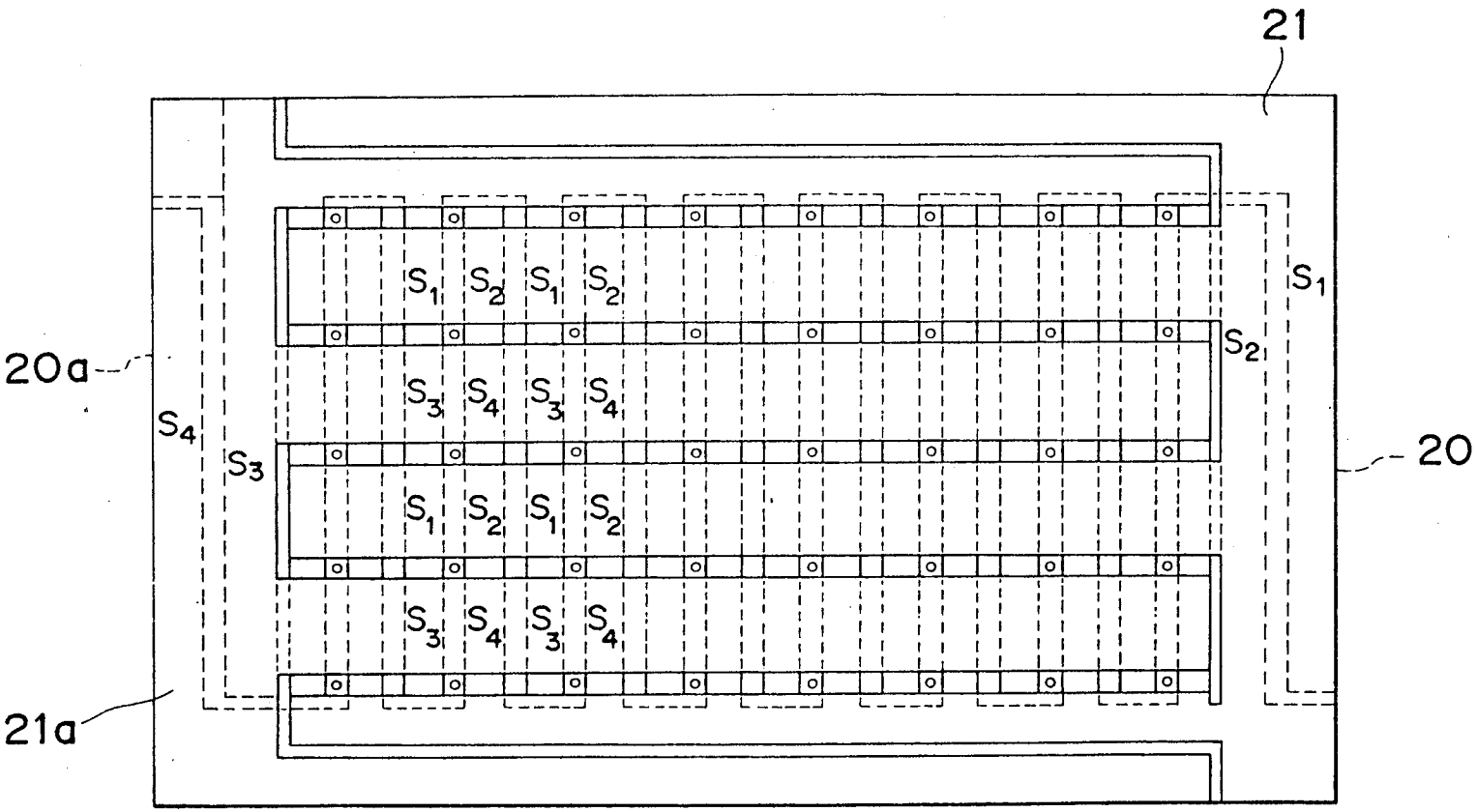
FIG. 1 is a plan view of a display device according to a preferred embodiment of the present invention.
Figure 2A:
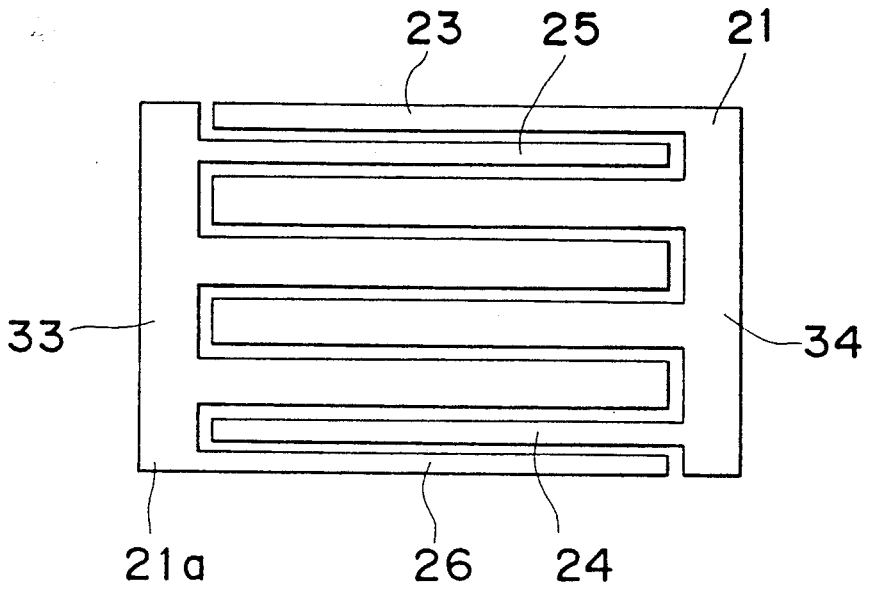
FIGS. 2*a* and 2*b* are plan views of electrodes used in the display device of FIG. 1.
Figure 2B:
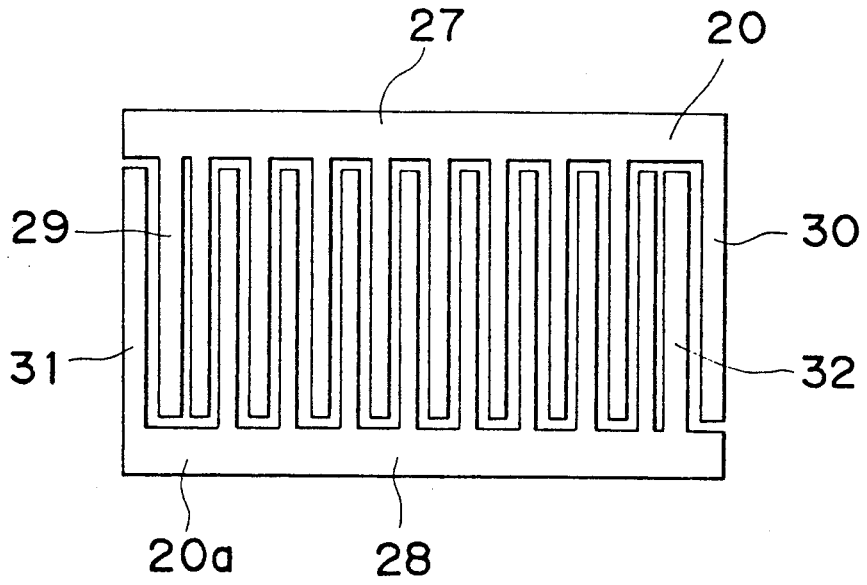

A preferred embodiment of the present invention will be described below with reference to FIGS. 1, 2*a* and 2*b*. FIGS. 2*a* and 2*b* respectively show vertical deflection electrodes 21 and 21*a*, and horizontal deflection electrode 20 and 20*a*. FIG. 1 is a drawing when these deflection electrodes are overlapped and are viewed from top.

As shown in FIG. 2*a*, the vertical deflection electrode is formed by a comb shaped electrode 21 which is interleaved with a comb shaped electrode 21*a* horizontally.

As shown in FIG. 2*b*, the horizontal deflection electrode is formed by a comb shaped electrode 20 which is interleaved with a comb shaped electrode 20*a* vertically.

The vertical deflection electrode overlaps the horizontal deflection electrode. The number of teeth in the vertical deflection electrode 21 is the same as that of the vertical deflection electrode 21*a*. Similarly, the numbers of teeth in the horizontal deflection electrodes 20 and 20*a* are same.

When the vertical and horizontal deflection electrodes are placed one over the other, the comb teeth 23 and 24, and 25 and 26 of the vertical deflection electrodes 21 and 21*a* which are respectively located vertically at the outermost positions are positioned over the connection portions 27 and 28 of the comb teeth of the horizontal deflection electrodes 20 and 20*a*, as shown in FIG. 1.

Similarly, the comb teeth 29, 30 and 31, 32 of the horizontal deflection electrodes 20 and 20*a* which are respectively located horizontally at the outermost positions are placed under the connection portions 33 and 34 of the comb teeth of the vertical deflection electrodes 21 and 21*a*. In FIG. 1, a slot marked by a circle represents a beam pierce-through hole.

In FIG. 1, the summed area of the portions where the vertical deflection electrode 21 and the horizontal deflection electrode 20 confronted each other is represented by $S_1$; the summed area of the portions where the vertical deflection electrode 21 is confronted with the horizontal deflection electrode 20*a* is represented by $S_2$; the summed area of the portions where the vertical deflection electrode 21*a* is confronted with the horizontal deflection electrode 20 is represented by $S_3$; and the summed area of the portions where the vertical deflection electrode 21*a* is confronted with the horizontal deflection electrode 20*a* is represented by $S_4$. In FIG. 1, the areas $S_1$, $S_2$, $S_3$ and $S_4$ are designated only partially for the sake of brevity.

Figure 5:
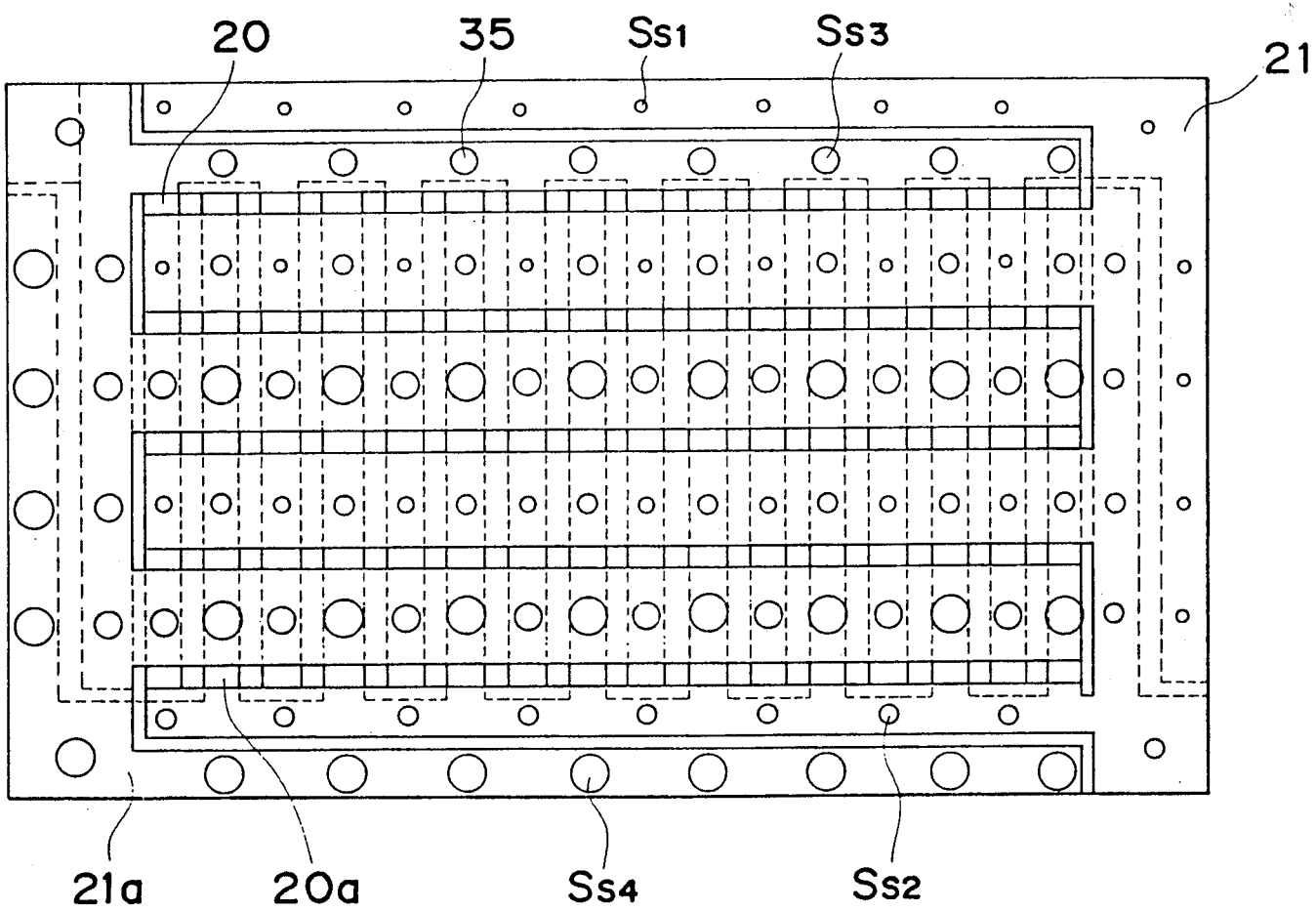
FIG. 5 is a plan view of a display device according to another preferred embodiment of the present invention.
Figure 7:
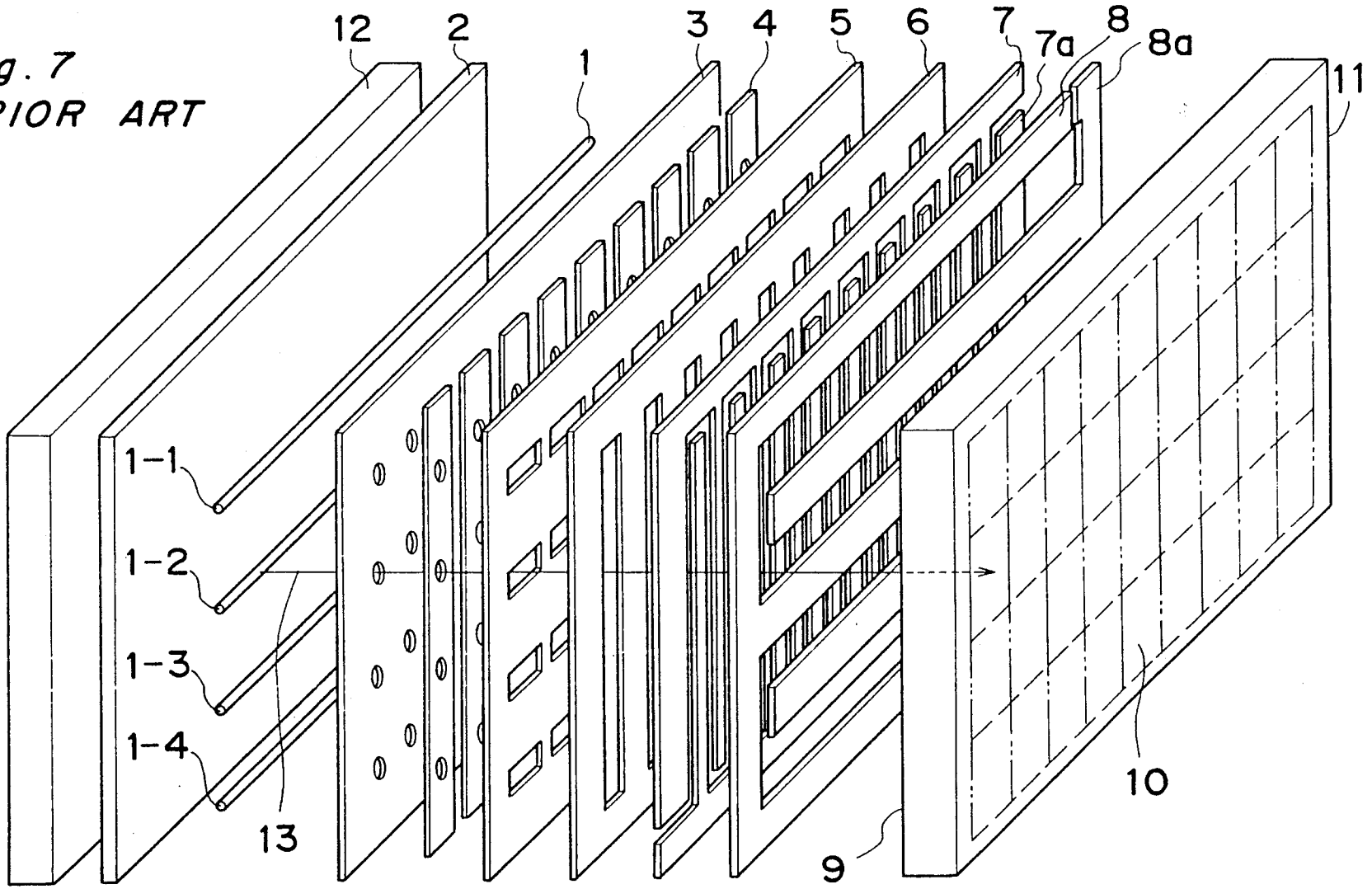
Fig. 7 PRIOR ART
FIG. 7 is a perspective view of the prior art flat plate type cathode ray tube.
Figure 8:
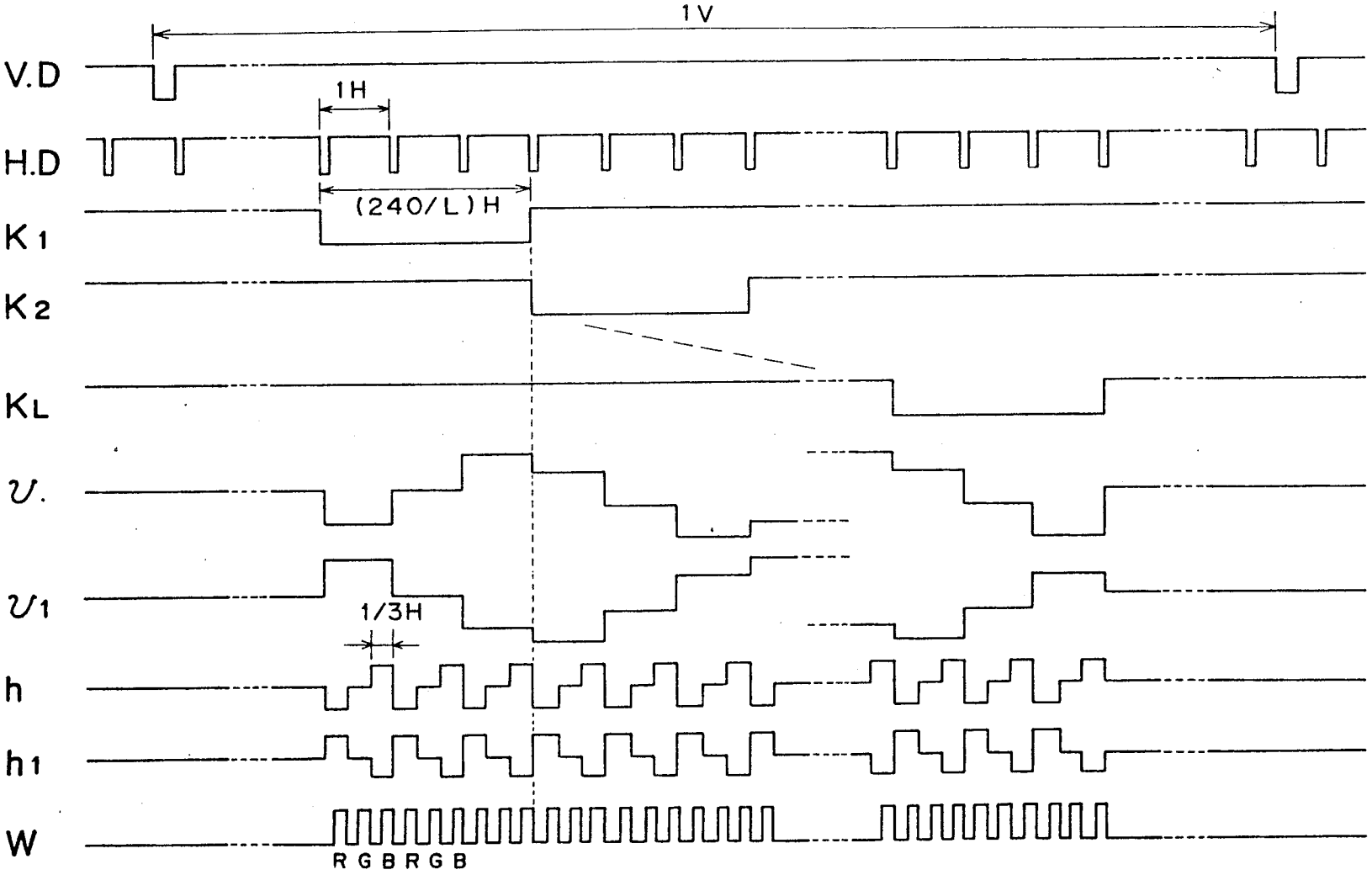
FIG. 8 is a graph showing deflection signals of the prior art image display device.
Figure 9:
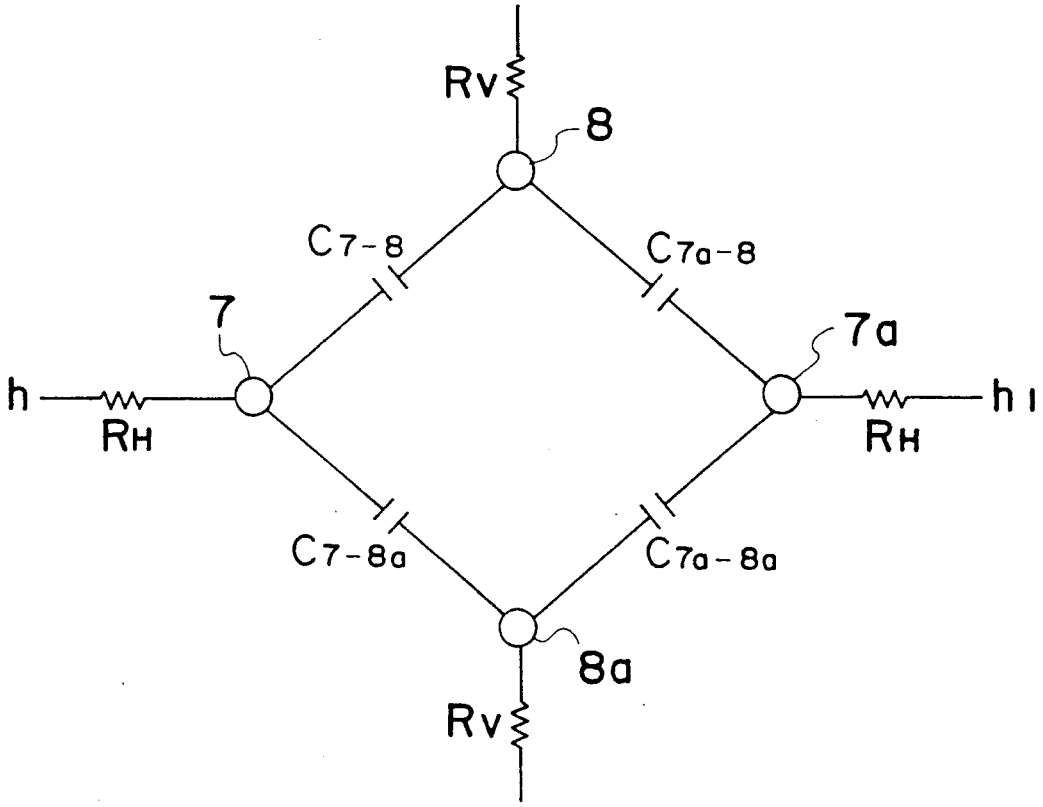
Fig. 9 PRIOR ART
FIG. 9 is a circuit showing capacitances between the electrodes in the prior art image display device of FIG. 8.
Figure 10A:
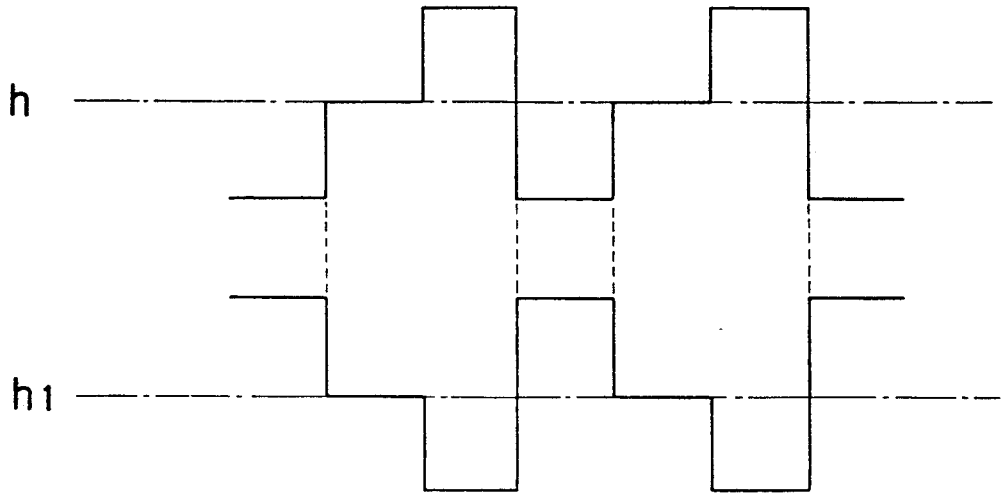
Fig 10a PRIOR ART
FIGS. 10*a*, 10*b* and 10*c* are graphs showing induced voltage waveforms in the circuit of FIG. 9.
Figure 10B:
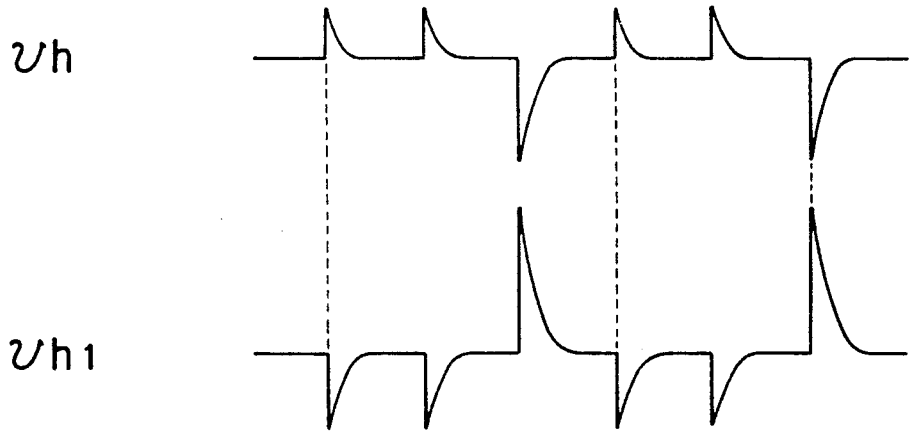
Fig.10b PRIOR ART
Figure 10C:
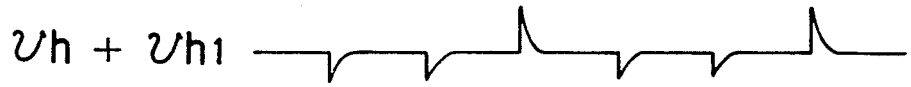
Fig.10c PRIOR ART

The electrodes are adjusted in size thereof so that $S_1$ and $S_2$ become equal to each other, and $S_3$ and $S_4$ become equal to each other. The distances between the vertical deflection electrodes 21 and 21*a* and the horizontal deflection electrodes 20 and 20*a* are kept constant by a suitable spacers 35, as shown in FIG. 5, inserted between the electrodes, so that the contact area of each spacer with the electrode, as well as the dielectric constant thereof, is made equal among the respective spaces between the vertical deflection electrodes 21 and 21*a* and the horizontal deflection electrodes 20 and 20*a*.

By the above-described arrangement, the capacitance $C_{21\text{-}20}$ between the vertical deflection electrode 21 and the horizontal deflection electrode 20 and the capacitance $C_{21\text{-}20a}$ between the vertical deflection electrode 21 and the horizontal deflection electrode 20*a* are made equal. Furthermore, the capacitance $C_{21a\text{-}20}$ between the vertical deflection electrode 21*a* and the horizontal deflection electrode 20 and the capacitance $C_{21a\text{-}20a}$ are made equal.

Figure 3:
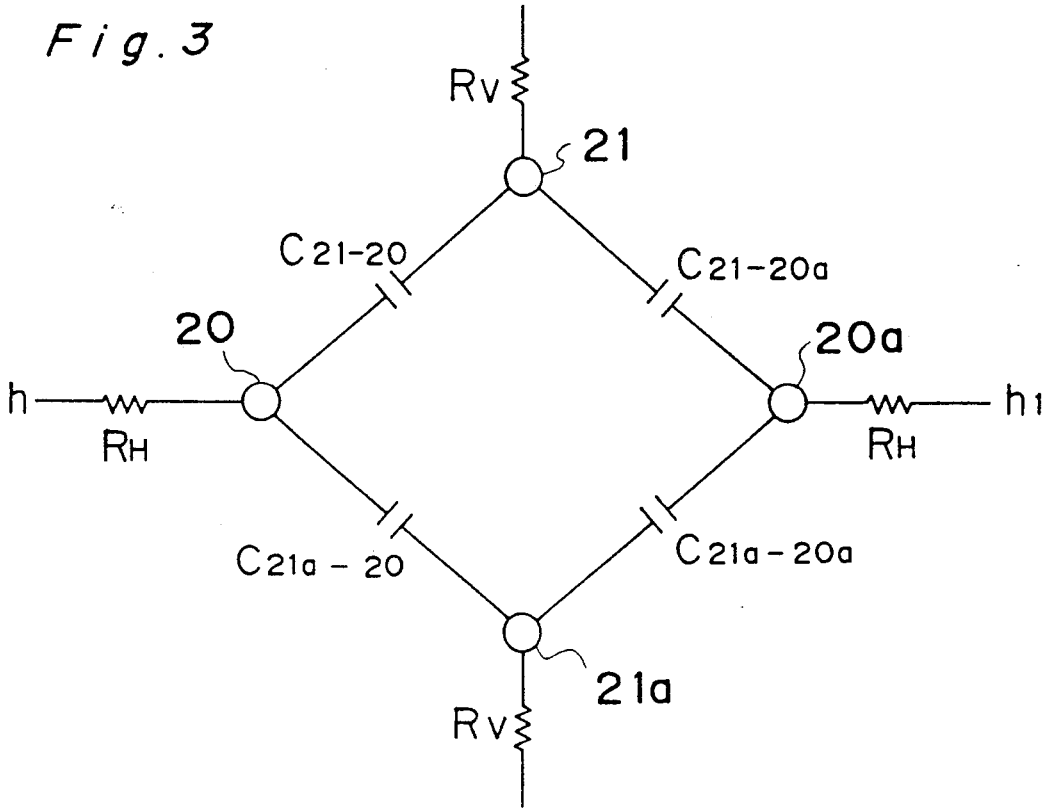
FIG. 3 is a circuit showing capacitances between the electrodes in the embodiment of FIG. 1.

Referring to FIG. 3, an equivalent circuit is shown for the above case wherein the capacitances between respective deflection electrodes are made equal. In FIG. 3, the circuit on the horizontal deflection 20 side and the circuit on the horizontal deflection electrode 20*a* side viewed from the vertical deflection electrodes 21 and 21*a* become symmetrical to each other, wherein $R_H$ and $R_V$ are respectively the output impedances of the horizontal deflection circuit and the vertical deflection circuit.

Figure 4A:
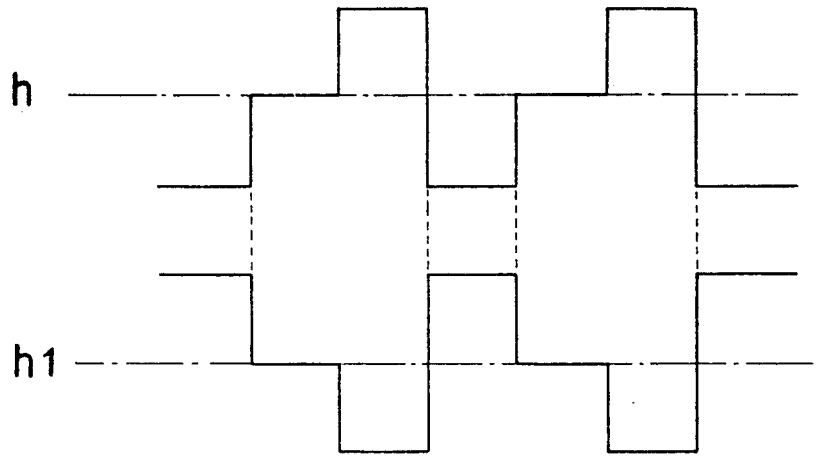
FIGS. 4*a*, 4*b* and 4*c* are graphs showing the induced voltage waveforms of the electrodes in FIG. 1.
Figure 4B:
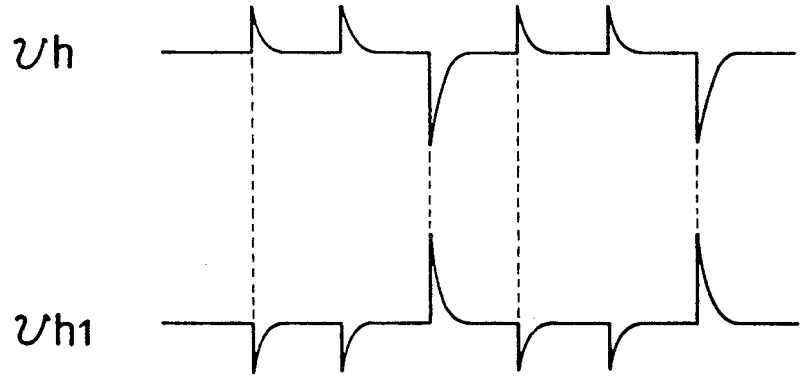
Figure 4C:
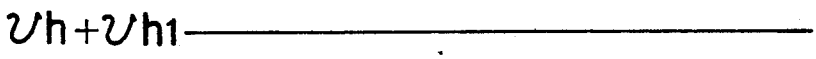

Accordingly, when, for example, horizontal deflection waveforms h and $h_1$ as shown in FIG. 4*a* are applied to respective horizontal deflection electrodes 20 and 20*a*, the voltages $v_h$ and $v_{h1}$ induced on the vertical deflection electrode 21 (21*a*) have opposite polarities, but have the same amplitudes as shown in FIG. 4*b*. When these voltages $v_h$ and $v_{h1}$ are added, $v_h+v_{h1}=0$ is obtained, indicating that no change will appear on the original deflection waveform.

In the actual case, although it is difficult to make respective capacitances described above absolutely equal, there arises no problem if respective capacitances are made approximately equal in such an extent that the visual change in the beam landing or focus caused by $(v_h+v_{h1})$ falls within a tolerable range.

Although the above description relates to the voltage induced on the vertical deflection electrodes by the horizontal deflection signal, the same can be applied to the voltage induced on the horizontal deflection electrodes by the vertical deflection signal. Furthermore, with respect to the voltage induced on electrodes other than the deflection electrodes, the same thing can be said.

Second Embodiment

A second preferred embodiment of the present invention will be described with reference to FIG. 5. The second embodiment is effective in the case where the confronting areas between respective electrodes referred to in the first embodiment can not be made equal because of the circumstances in the design. In the second embodiment, the summed areas of the portions where the vertical deflection electrodes 21 and 21*a* and the horizontal deflection electrodes 20 and 20*a* are confronted with each other are represented by $S_1$, $S_2$, $S_3$ and $S_4$. However, it is assumed that they are not equal, but $S_1>S_2>S_3>S_4$, in accordance with these area ratios. In this case, the respective capacitances become as follows.

$$C_{s1}>C_{s2}>C_{s3}>C_{s4}$$

Figure 11:
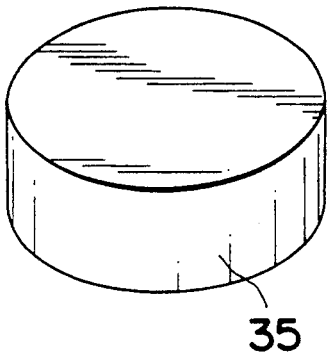
FIG. 11 is a perspective view of a spacer.

Here, the contact areas wherein ceramic insulation spacers 35 determining respective electrode distances contact respective electrodes are made different from each other so as to be $S_{s1}<S_{s2}<S_{s3}<S_{s4}$ and the capacitances thereof are set as follows. An example of one spacer is shown in FIG. 11.

(a) Between the vertical deflection electrode 21 and the horizontal deflection electrode 20*a*

$$C_a=C_{s1}-C_{s2}$$

(b) Between the vertical deflection electrode 21*a* and the horizontal deflection electrode 20

$$C_b=C_{s1}-C_{s3}$$

(c) Between the vertical deflection electrode 21*a* and the horizontal deflection electrode 20*a*

$$C_c=C_{s1}-C_{s4}$$

In FIG. 5, the difference in the area of the respective insulation spacer 35 is represented by the size of the circle, i.e., the larger the spacer area, the larger the marked circle. As a result, between respective deflection electrodes, respective summed areas confronting with each other with a free space therebetween and an area portion confronting with a spacer therebetween all become equal. As a result, the capacitances between the vertical deflection electrodes 21 and 21*a* and the horizontal deflection electrodes 20 and 20*a* become equal to each other, as in the first embodiment.

More specifically, as described in the first embodiment, the vertical deflection signal and the horizontal deflection signal do not interfere with each other. Furthermore, with respect to the voltage induced electrodes other than the deflection electrodes, the same may be said.

Figure 12:
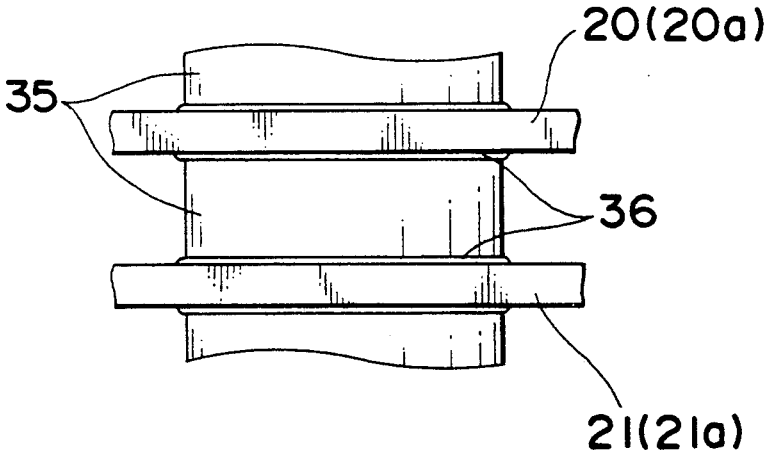
FIG. 12 is a side view showing a spacer held between electrodes.

As an affixing method for these insulation spacers, a bonding method with fritted glass 36, as shown in FIG. 12, or a fixing method with pins may be used.

Furthermore, since the capacitance formed by the insulation spacer may be controlled by the dielectric constant of the spacer, it may be applicable to set respective ratios of dielectric constant so as to meet the conditions (a), (b) and (c), instead of controlling the respective contact areas of spacers.

Furthermore, although it is actually difficult to make the above-described respective capacitances absolutely equal to each other, there is no problem if the capacitances are approximately equal in such an extent that the change in the beam landing or the focus caused by $(v_h+V_{h1})$ will fall within a tolerable range.

Third Embodiment

Figure 6:
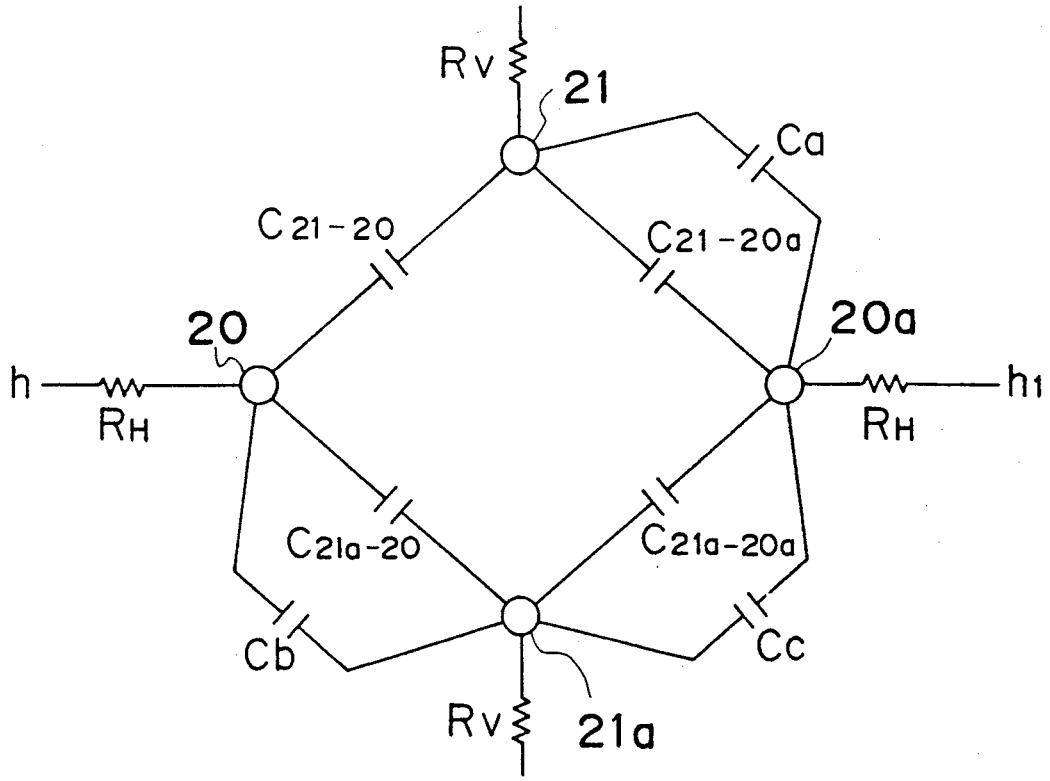
FIG. 6 is a circuit showing capacitances between the electrodes in the embodiment of FIG. 5.

A third preferred embodiment of the present invention will be described below with reference to FIG. 6. When the electrode designing is made without considering on the capacitances between respective electrodes as conventionally made, the capacitances $C_{21\text{-}20}$, $C_{21\text{-}20a}$ and $C_{21a\text{-}20}$, $C_{21a\text{-}20a}$ between the vertical deflection electrodes 21, 21*a* and the horizontal deflection electrodes 20, 20*a* do not become equal. When the measurement result is $C_{21\text{-}20}>C_{21\text{-}20a}>C_{21a\text{-}20}>C_{21a\text{-}20a}$, the capacitors having the following capacitances are connected between the vertical deflection electrodes 21, 21*a* and the horizontal deflection electrode 20, 20*a* so as to add compensating capacitances thereto externally.

(a) Between the vertical deflection electrode 21 and the horizontal deflection electrode 20*a*

$$C_a=C_{21\text{-}20}-C_{21\text{-}20a}$$

(b) Between the vertical deflection electrode 21*a* and the horizontal deflection electrode 20

$$C_b=C_{21\text{-}20}-C_{21a\text{-}20}$$

(c) Between the vertical deflection electrode 21*a* and the horizontal deflection electrode 20*a*

$$C_c=C_{21\text{-}20}-C_{21a\text{-}20a}$$

As a result, the capacitance between the vertical deflection electrodes 21 and 21*a* and the horizontal deflection electrodes 20 and 20*a* all become equal, and as described in the first embodiment, the vertical deflection signal and the horizontal deflection signal do not interfere with each other. Furthermore, the same can be said to the voltage induced in electrodes other than the deflection electrodes.

In these embodiments, although the description is made only with respect to the flat plate type cathode ray tube, the description may be also widely applicable to the display device using electron beam.

Furthermore, although the electron beam deflection electrodes and other electrodes are of a flat plate type in the foregoing embodiments, the present invention is not limited to this type of electrodes, but may be applicable also to electrodes of a block type.

In the image display device of the present invention, the waveform distortion due to the difference in the induced voltage between the deflection electrodes can be easily removed by equalizing the capacitances between respective deflection electrodes, and an image free from distortions, unevenness in color, or unevenness in brightness can be obtained.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be constructed as included therein.

What is claimed is:

1. An image display device comprising:

first and second comb shaped electrodes having a plurality of teeth and disposed interleavingly in a first plane for forming electron beam passges therebetween for effecting an electron beam deflection in a first direction;

third and fourth comb shaped electrodes having a plurality of teeth and disposed interleavingly in a second plane parallel to said first plane for forming electron beam passages therebetween for effecting an electron beam deflection in a second direction, said teeth of the first and second comb shaped electrodes orthogonally intersecting said teeth of the third and fourth comb shaped electrodes;

a plurality of spacers, made of an electrically insulating material, at least one spacer inserted between said first and third comb shaped electrodes at a teeth intersecting portion, and at least one spacer inserted between said first and fourth comb shaped electrodes at a teeth intersecting portion, and at least one spacer inserted between said second and third comb shaped electrodes at a teeth intersecting portion, and at least one spacer inserted between said second and fourth comb shaped electrodes at a teeth intersecting portion;

said spacers having preselected size and dielectric constant so that a first capacitance between said first and third comb shaped electrodes is substantially equal to a second capacitance between said second and third comb shaped electrodes, and, at the same time, a third capacitance between said first and fourth comb shaped electrodes is substantially equal to a fourth capacitance between said second and fourth comb shaped electrodes.

2. An image display device as claimed in claim 1, wherein said spacers are so selected that said first, second, third and fourth capacitances have the same capacitance values.

3. An image display device as claimed in claim 1, wherein said first direction and said second directions in which the electron beam deflections are effected are respectively horizontal and vertical directions.

4. An image display device as claimed in claim 1, wherein said first direction and said second directions in which the electron beam deflections are effected are respectively vertical and horizontal directions.

5. An image display device comprising:

first and second comb shaped electrodes having a plurality of teeth and disposed interleavingly in a first plane for forming electron beam passages therebetween for effecting an electron beam deflection in a first direction;

third and fourth comb shaped electrodes having a plurality of teeth and disposed interleavingly in a second plane parallel to said first plane for forming electron beam passages therebetween for effecting an electron beam defection in a second direction, said teeth of the first and second comb shaped electrodes orthogonally intersecting said teeth of the third and fourth comb shaped electrodes;

a first externally connected capacitor means connected to at least one of two places which are between said first and third comb shaped electrodes and between said second and third comb shaped electrodes so that a first capacitance between said first and third comb shaped electrodes is substantially equal to a second capacitance between said second and third comb shaped electrodes; and a second externally connected capacitor means connected to at least one of two places which are between said first and fourth comb shaped electrodes and between said second and fourth comb shaped electrodes so that a third capacitance between said first and fourth comb shaped electrodes is substantially equal to a fourth capacitance between said second and fourth comb shaped electrodes.

6. An image display device as claimed in claim 5, wherein said first and second externally connected capacitor means are so selected that said first, second, third and fourth capacitances have the same capacitance values.

7. An image display device as claimed in claim 5, wherein said first direction and said second directions in which the electron beam deflections are effected are respectively horizontal and vertical directions.

8. An image display device as claimed in claim 5, wherein said first direction and said second directions in which the electron beam defections are effected are respectively vertical and horizontal directions.

* * * * *